US007250013B2

(12) United States Patent
Hao

(10) Patent No.: US 7,250,013 B2
(45) Date of Patent: Jul. 31, 2007

(54) DETACHABLE TABLE TENNIS APPARATUS

(76) Inventor: Guan Qun Hao, 55 Cochranes Rd., Moorabbin, Victoria (AU) 3189

( * ) Notice: Subject to any disclaimer, the term of this patent is extended or adjusted under 35 U.S.C. 154(b) by 0 days.

(21) Appl. No.: 11/264,800

(22) Filed: Nov. 1, 2005

(65) Prior Publication Data

US 2007/0099733 A1 May 3, 2007

(51) Int. Cl.
*A47B 96/18* (2006.01)

(52) U.S. Cl. ..... 473/496; 108/90

(58) Field of Classification Search ..... 473/10, 473/14, 496; 108/59, 69, 90
See application file for complete search history.

(56) References Cited

U.S. PATENT DOCUMENTS 885,630 A * 4/1908 Mason ..... 108/79
955,804 A * 4/1910 Hyde ..... 108/90
1,276,015 A * 8/1918 Belknap ..... 273/317.4
2,115,115 A * 4/1938 Matteson et al. ..... 473/14
2,556,943 A * 6/1951 Reisman ..... 108/90
2,955,888 A * 10/1960 Graves ..... 108/69
4,765,619 A * 8/1988 Cooper ..... 473/496
5,833,559 A * 11/1998 Appelbaum et al. ..... 473/496
6,659,879 B1 * 12/2003 Cartwright ..... 473/8
6,729,982 B1 * 5/2004 Appelbaum et al. ..... 473/496
6,823,804 B2 * 11/2004 Arnell ..... 108/90
2002/0073901 A1 * 6/2002 Arnell ..... 108/90
2005/0255928 A1 * 11/2005 Nally ..... 473/10

* cited by examiner

*Primary Examiner*—Raleigh W. Chiu
(74) *Attorney, Agent, or Firm*—Alan Kamrath; Kamrath + Associates PA

(57) ABSTRACT

A detachable table tennis apparatus includes a playing table detachably mounted on a table, and a plurality of positioning devices mounted on the playing table to position the playing table on the table. Thus, the playing table is mounted on tables of different sizes to facilitate a user playing the table tennis. In addition, the fixing block is driven by the two movable plates to press or release the rim of the table so as to lock or unlock the playing table, so that the playing table is mounted on and detached from the table easily and rapidly. Further, the playing table is foldable when not in use to reduce the volume of the table tennis apparatus, thereby facilitating storage and transportation of the table tennis apparatus.

13 Claims, 3 Drawing Sheets

DETACHABLE TABLE TENNIS APPARATUS

BACKGROUND OF THE INVENTION

1. Field of the Invention

The present invention relates to a table tennis apparatus, and more particularly to a detachable table tennis apparatus.

2. Description of the Related Art

A conventional table for the table tennis comprises two playing surfaces juxtaposed to each other. Each of two playing surfaces has a bottom provided with a plurality of legs. However, the conventional table has a larger fixed volume, so that the table cannot be folded when not in use, thereby causing inconvenience to a user in storage, package and transportation of the table.

SUMMARY OF THE INVENTION

In accordance with the present invention, there is provided a table tennis apparatus, comprising a playing table detachably mounted on a table, and a plurality of positioning devices mounted on the playing table to position the playing table on the table.

The primary objective of the present invention is to provide a detachable table tennis apparatus.

Another objective of the present invention is to provide a table tennis apparatus, wherein the playing table is mounted on tables of different sizes to facilitate a user playing the table tennis, thereby enhancing the versatility of the table tennis apparatus.

A further objective of the present invention is to provide a table tennis apparatus, wherein the fixing block is driven by the two movable plates to press or release the rim of the table so as to lock or unlock the playing table, so that the playing table is mounted on and detached from the table easily and rapidly, thereby facilitating the user assembling and disassembling the table tennis apparatus.

A further objective of the present invention is to provide a table tennis apparatus, wherein the playing table needs not to provide legs, so that the table tennis apparatus is foldable when not in use so as to reduce the volume of the table tennis apparatus, thereby facilitating storage, package and transportation of the table tennis apparatus.

Further benefits and advantages of the present invention will become apparent after a careful reading of the detailed description with appropriate reference to the accompanying drawings.

DETAILED DESCRIPTION OF THE INVENTION

Figure 1:
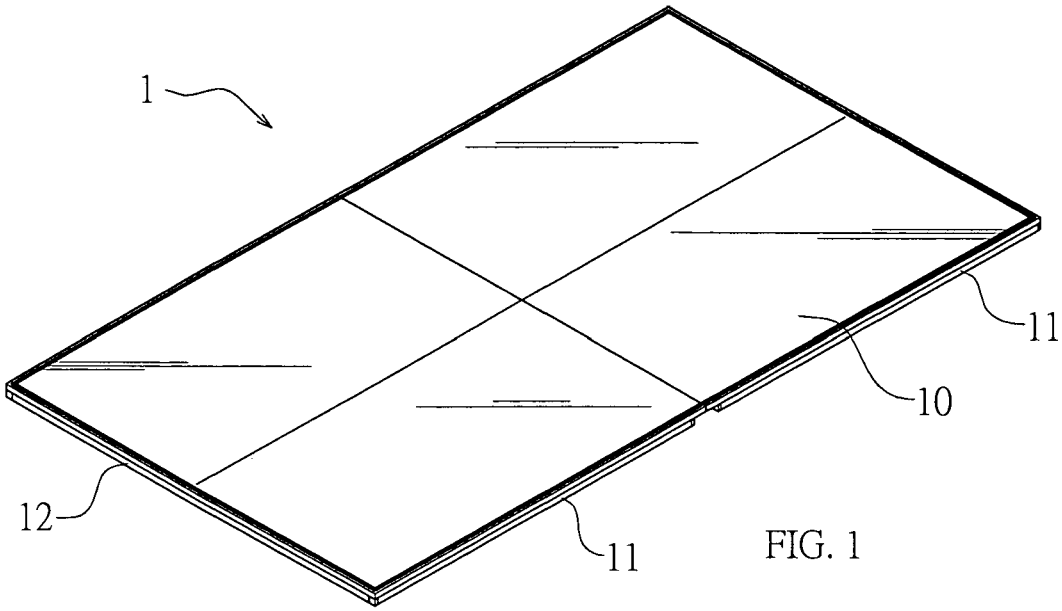
FIG. 1 is a perspective view of a table tennis apparatus in accordance with the preferred embodiment of the present invention.
Figure 2:
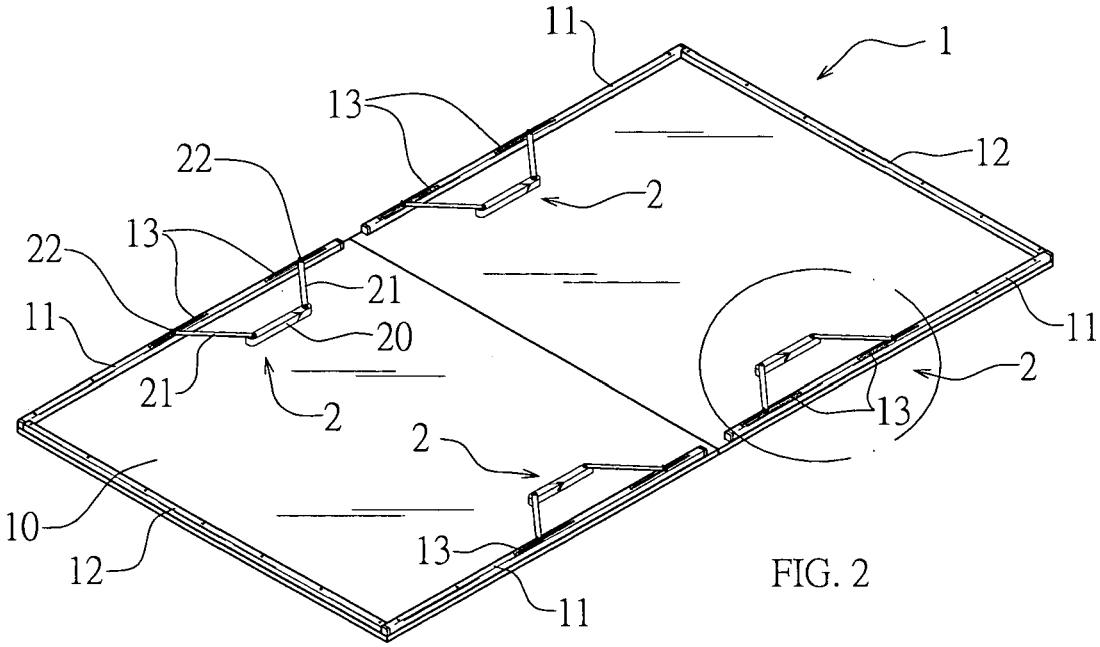
FIG. 2 is a bottom perspective view of the table tennis apparatus as shown in FIG. 1.
Figure 3:
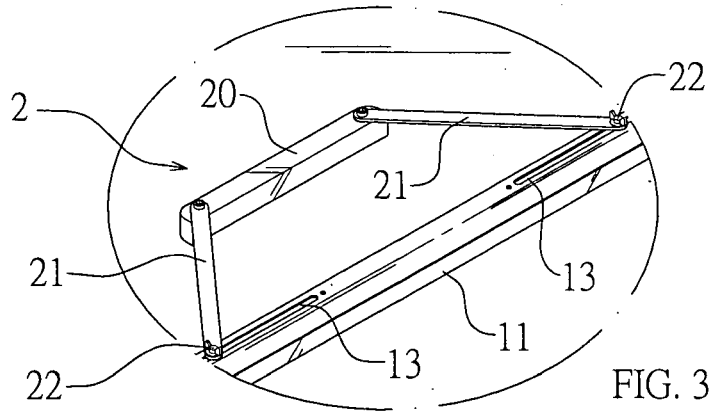
FIG. 3 is a locally enlarged view of the table tennis apparatus as shown in FIG. 2.
Figure 4:
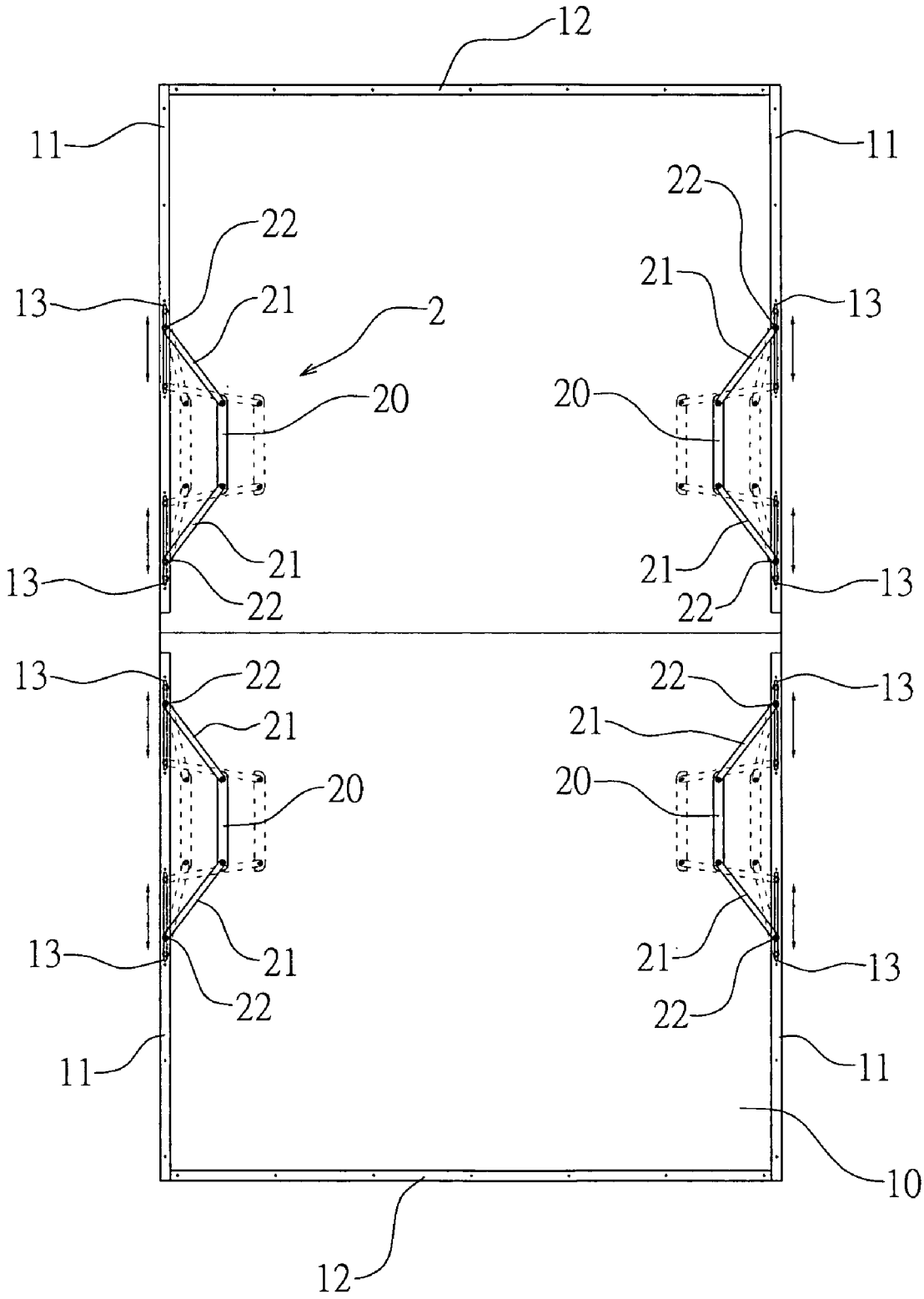
FIG. 4 is a schematic plan operational view of the table tennis apparatus as shown in FIG. 2 in use.
Figure 6:
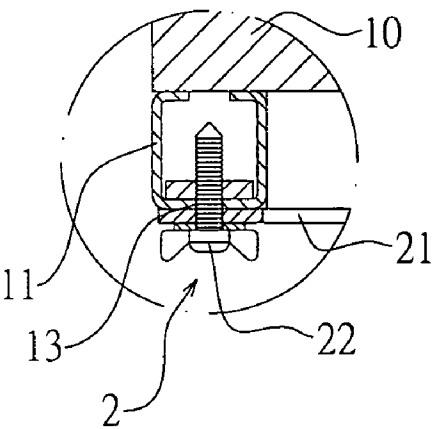
FIG. 6 is a locally enlarged view of the table tennis apparatus as shown in FIG. 5.

Referring to the drawings and initially to FIGS. 1–5, a detachable table tennis apparatus in accordance with the preferred embodiment of the present invention comprises a playing table 1 detachably mounted on a table 102, and a plurality of positioning devices 2 mounted on the playing table 1 to position the playing table 1 on the table 102.

The playing table 1 includes two playing surfaces 10 pivotally connected with each other. The playing table 1 has a bottom having a periphery provided with two opposite side rails 11 and two opposite end rails 12 located between the two opposite side rails 11. Each of the two opposite side rails 11 of the playing table 1 is formed with a plurality of axially extending elongated limit slots 13.

Each of the positioning devices 2 is mounted on the respective side rail 11 of the playing table 1 and urged on a rim 104 of the table 102. Each of the positioning devices 2 includes a fixing block 20 movable on the bottom of the playing table 1, and two movable plates 21 each having a first end movably mounted on the respective side rail 11 of the playing table 1 and a second end pivotally mounted on one of two ends of the fixing block 20.

The fixing block 20 of each of the positioning devices 2 is parallel with the respective side rail 11 of the playing table 1. The fixing block 20 of each of the positioning devices 2 is driven by the two movable plates 21 and movable between a first position where the fixing block 20 presses the rim 104 of the table 102 and a second position where the fixing block 20 is detached from the rim 104 of the table 102.

Each of the two movable plates 21 of each of the positioning devices 2 is slidable in the respective limit slot 13 of the respective side rail 11 of the playing table 1. The first end of each of the two movable plates 21 of each of the positioning devices 2 is pivotally mounted in the respective limit slot 13 of the respective side rail 11 of the playing table 1 by an adjusting blot 22 which is slidable in the respective limit slot 13 of the respective side rail 11 of the playing table 1.

Thus, when the adjusting blot 22 is screwed onto the respective side rail 11 of the playing table 1, the first end of each of the two movable plates 21 is secured in the respective limit slot 13 of the respective side rail 11 of the playing table 1, and when the adjusting blot 22 is unscrewed from the respective side rail 11 of the playing table 1, the first end of each of the two movable plates 21 is slidable in the respective limit slot 13 of the respective side rail 11 of the playing table 1.

Figure 5:
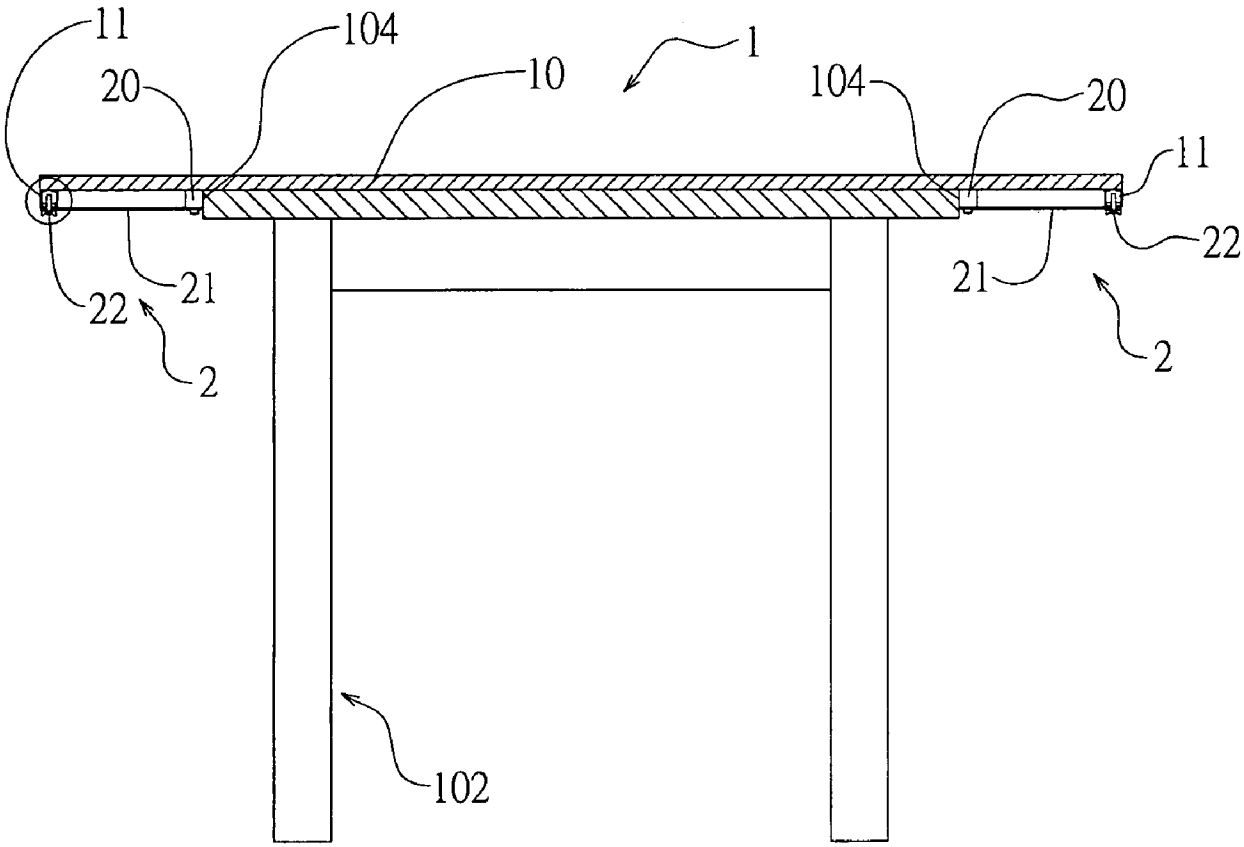
FIG. 5 is a schematic plan cross-sectional operational view of the table tennis apparatus as shown in FIG. 1 in use.

In assembly, referring to FIGS. 1–6, the playing table 1 is initially placed on the table 102. Then, the first end of each of the two movable plates 21 is slidable in the respective limit slot 13 of the respective side rail 11 of the playing table 1, so that the fixing block 20 of each of the positioning devices 2 is driven by the two movable plates 21 and movable to the position as shown in FIG. 5 until the fixing block 20 presses the rim 104 of the table 102. Then, the adjusting blot 22 is screwed onto the respective side rail 11 of the playing table 1, so that the first end of each of the two movable plates 21 is secured in the respective limit slot 13 of the respective side rail 11 of the playing table 1 so as to lock the two movable plates 21 and the fixing block 20. Thus, each of the two opposite side rails 11 of the playing table 1 is locked on the rim 104 of the table 102 by the positioning devices 2, thereby positioning the playing table 1 on the table 102 rigidly and stably.

Accordingly, the playing table 1 is mounted on tables of different sizes to facilitate a user playing the table tennis, thereby enhancing the versatility of the table tennis apparatus. In addition, the fixing block 20 is driven by the two movable plates 21 to press or release the rim 104 of the table 102 so as to lock or unlock the playing table 1, so that the playing table 1 is mounted on and detached from the table 102 easily and rapidly, thereby facilitating the user assembling and disassembling the table tennis apparatus. Further, the playing table 1 needs not to provide legs, so that the table tennis apparatus is foldable when not in use so as to reduce the volume of the table tennis apparatus, thereby facilitating storage, package and transportation of the table tennis apparatus.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A table tennis apparatus, comprising:

a playing table detachably mounted on a table;

a plurality of positioning devices mounted on the playing table to position the playing table on the table;

wherein the playing table has a bottom having a periphery provided with two opposite side rails;

each of the positioning devices is mounted on the respective side rail of the playing table and urged on a rim of the table;

each of the positioning devices includes a fixing block movable on the bottom of the playing table, and two movable plates each having a first end movably mounted on the respective side rail of the playing table and a second end pivotally mounted on one of two ends of the fixing block.

2. The table tennis apparatus in accordance with claim 1, wherein the fixing block of each of the positioning devices is parallel with the respective side rail of the playing table.

3. The table tennis apparatus in accordance with claim 1, wherein the fixing block of each of the positioning devices is driven by the two movable plates and movable between a first position where the fixing block presses the rim of the table and a second position where the fixing block is detached from the rim of the table.

4. The table tennis apparatus in accordance with claim 1, wherein each of the two opposite side rails of the playing table is formed with a plurality of axially extending elongated limit slots.

5. The table tennis apparatus in accordance with claim 4, wherein the each of the two movable plates of each of the positioning devices is slidable in the respective limit slot of the respective side rail of the playing table.

6. The table tennis apparatus in accordance with claim 4, wherein the first end of each of the two movable plates of each of the positioning devices is pivotally mounted in the respective limit slot of the respective side rail of the playing table by an adjusting blot.

7. The table tennis apparatus in accordance with claim 6, wherein when the adjusting blot is screwed onto the respective side rail of the playing table, the first end of each of the two movable plates is secured in the respective limit slot of the respective side rail of the playing table, and when the adjusting blot is unscrewed from the respective side rail of the playing table, the first end of each of the two movable plates is slidable in the respective limit slot of the respective side rail of the playing table.

8. The table tennis apparatus in accordance with claim 6, wherein the adjusting blot is slidable in the respective limit slot of the respective side rail of the playing table.

9. The table tennis apparatus in accordance with claim 1, wherein the playing table includes two playing surfaces pivotally connected with each other.

10. The table tennis apparatus in accordance with claim 1, wherein the periphery of the bottom of the playing table is provided with two opposite end rails located between the two opposite side rails.

11. The table tennis apparatus in accordance with claim 1, wherein each of the two opposite side rails of the playing table is locked on the rim of the table by the positioning devices, thereby positioning the playing table on the table.

12. The table tennis apparatus in accordance with claim 1, wherein the table has different sizes.

13. The table tennis apparatus in accordance with claim 1, wherein the playing table is foldable.

* * * * *